US009335089B1

(12) United States Patent
Gossens

(10) Patent No.: US 9,335,089 B1
(45) Date of Patent: May 10, 2016

(54) ARMLESS SLIDE UNDER SHELF

(71) Applicant: Electrolux Home Products, Inc., Charlotte, NC (US)

(72) Inventor: Caleb Gossens, Kalamazoo, MI (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 14/548,454

(22) Filed: Nov. 20, 2014

(51) Int. Cl.
*A47B 11/00* (2006.01)
*F25D 25/02* (2006.01)
*A47B 96/06* (2006.01)
*A47B 96/02* (2006.01)

(52) U.S. Cl.
CPC ..... *F25D 25/024* (2013.01); *A47B 96/025* (2013.01); *A47B 96/062* (2013.01)

(58) Field of Classification Search
CPC ..... F25D 25/024
USPC ..... 108/71, 73, 75, 77, 78, 93, 108; 312/408, 410
See application file for complete search history.

(56) References Cited

U.S. PATENT DOCUMENTS 2,022,318 A * 11/1935 Lanum ..... A47B 1/05 108/75
2,240,551 A * 5/1941 Cooper ..... A47B 1/02 108/75
3,859,932 A * 1/1975 Armstrong ..... A47B 96/025 108/138
4,316,082 A * 2/1982 Fritz ..... A47B 21/0314 108/32
4,620,489 A * 11/1986 Albano ..... A47B 96/025 108/105
5,040,856 A 8/1991 Wilkins et al.
5,340,209 A 8/1994 Kolbe et al.
5,735,589 A 4/1998 Herrmann et al.
6,846,052 B2 * 1/2005 Kelley ..... A47B 21/0314 108/93
7,645,001 B2 1/2010 Harris
8,777,341 B2 7/2014 Amaral et al.
8,840,205 B2 * 9/2014 Chellappan ..... F25D 23/067 108/93
9,033,438 B2 * 5/2015 Kelly ..... F25D 25/024 108/102
9,103,582 B2 * 8/2015 Nash ..... F25D 25/024
2007/0228909 A1 * 10/2007 Hwang ..... F25D 25/024 312/408
2009/0051257 A1 * 2/2009 Picken ..... F25D 25/024 312/408
2011/0001415 A1 1/2011 Park et al.
2012/0074825 A1 3/2012 Armstrong et al.
2012/0091084 A1 * 4/2012 Amaral ..... F25D 25/024 211/80
2012/0273504 A1 11/2012 Rackley et al.

FOREIGN PATENT DOCUMENTS

EP 2419691 A2 2/2012
WO 2010/118492 A2 10/2010

OTHER PUBLICATIONS

International Search Report and Written Opinion of Corresponding Application No. PCT/US2015/060074; Dated Feb. 16, 2016.

* cited by examiner

*Primary Examiner* — Matthew Ing
(74) *Attorney, Agent, or Firm* — Pearne & Gordon LLP

(57) ABSTRACT

A slide under shelf for a refrigeration appliance may be in a fully retracted position (i.e., with a second shelf area stored underneath a first shelf area) without having permanently extended support arms. That is, the retracted shelf may be extended by pulling out the second shelf area without requiring permanently extend support arms with a track or rail to support the second shelf area. Rather, the second shelf area has front slides that extend beyond the rear of a top surface of the second shelf area and ride along a track of support arms that do not extend beyond a top surface of the first shelf area. The support arms may also have posts that ride along a track on the front slides.

16 Claims, 6 Drawing Sheets

ARMLESS SLIDE UNDER SHELF

BACKGROUND OF THE INVENTION

1. Field of the Invention

The present invention is related generally to shelving and refrigeration appliances, and, more particularly, to an armless slide under shelf for a refrigeration appliance.

2. Description of Related Art

Traditionally, refrigeration appliances have used customizable shelving for storing items. These shelves can be rearranged within the appliance based on a user's desires or needs given the items stored thereon. Some such shelves allow the shelving to be "pulled out", so as to provide easier access to items stored near the back of the appliance or to provide additional shelving area. However, such shelves require permanently extended support arms and/or that the additional shelving be foldable. Accordingly, such permanently extended arms restrict movement in areas in front of the shelving and foldable arms give rise to complicated structural elements that can affect the integrity and cost of the shelf.

BRIEF SUMMARY OF THE INVENTION

The following summary is meant only to provide a basic overview of the present invention and is therefore not meant to be limiting in any way. In light of the above, there is presently a need for shelves having an extendable shelving area without requiring permanently extended support arms or a foldable shelf. More particularly, there is a need for such shelves in refrigeration appliances.

According to one example of the present invention, a slide under shelf comprises a first shelf area having a first top surface and support arms attached to opposite sides of the top surface, wherein the support arms each have a first track that extends longitudinally on an interior face and the support arms and the support arms each have a first sliding member beyond the track in a first longitudinal direction, and wherein the support arms do not extend beyond the top surface in the first longitudinal direction; and a second shelf area having a second top surface and front slides attached to opposite sides of the top surface, wherein the front slides each have a second track that extends longitudinally on an exterior face and a second sliding member beyond the track and the second top surface in a second longitudinal direction, wherein the second sliding member of the front slides fits within the first track of the support arms, and the first sliding member of the support arms fits within the second track of the front slides According to various embodiments of the above example, the second shelf area further comprises a handle; the second sliding member is a wheel; the first top surface and second top surface are glass; the support arms and front slides are plastic; the first track of the support arms comprises a first horizontal section, a ramp section, and a second horizontal section, the second horizontal section being closer to the first top surface than, and substantially parallel with, the first horizontal section; the second track of the front slides comprises a horizontal section and an arcuate section, the arcuate section located at the end of the horizontal section closest to the second sliding member; and/or the shelf is installed in a refrigeration appliance.

According to another example of the present invention, a slide under shelf comprises a first shelf area having a first top surface and support arms attached to opposite sides of the top surface, wherein the support arms each have a track that extends longitudinally, the track having a horizontal section and an arcuate section, and wherein the support arms do not extend beyond the top surface in a first longitudinal direction; and a second shelf area having a second top surface and front slides attached to opposite sides of the top surface, wherein the front slides each have a first sliding member and second sliding member on an exterior face of the front slides that extends beyond the second top surface in a second longitudinal direction, wherein the first sliding member and second sliding member of the front slides fit within the track of the support arms.

According to various embodiments of the above example, the horizontal section comprises a plurality of teeth and the first sliding member is a toothed wheel; in an extended state, the first sliding member fits within the horizontal section of the track and the second sliding member fits within the arcuate section of the track; the second shelf area further comprises a handle; the first top surface and second top surface are glass; the support arms and front slides are plastic; and/or the shelf is installed in a refrigeration appliance.

DETAILED DESCRIPTION OF THE INVENTION

Figure 1:
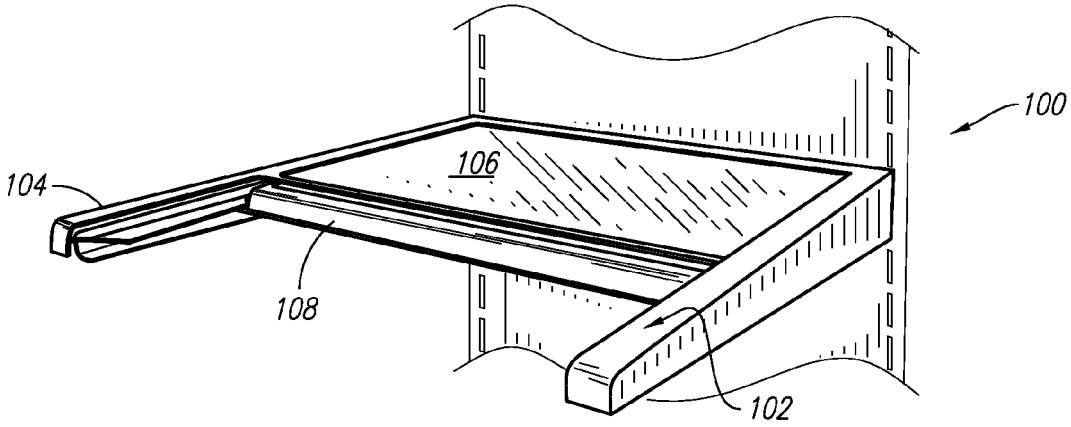
FIG. 1 PRIOR ART
FIG. 1 illustrates an extendable shelf requiring permanently extended support arms.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

The present invention pertains to an armless slide under shelf for a refrigeration appliance. Traditionally, extendable shelves have required either permanently extended arms or a foldable shelving space. For example, FIG. 1 illustrates an example shelf 100 requiring permanently extended support arms 102, 104. The shelf 100 has a first shelf area 106 that extends about half of the length of two permanently extend support arms 102, 104. In a retracted state (as shown), a second shelf area with handle 108 is stored under the first shelf area 106, and is pulled outward along rails of the permanently extended support arms 102, 104 to extend the shelving area. Therefore, as the second shelf area slides out from under the first shelf area 106, the shelf 100 is considered a slide under shelf. However, because the second shelf area is pulled outward along rails of the support arms 102, 104, these arms 102, 104 must be permanently extended to support such extension of the shelf area.

Figure 2A:
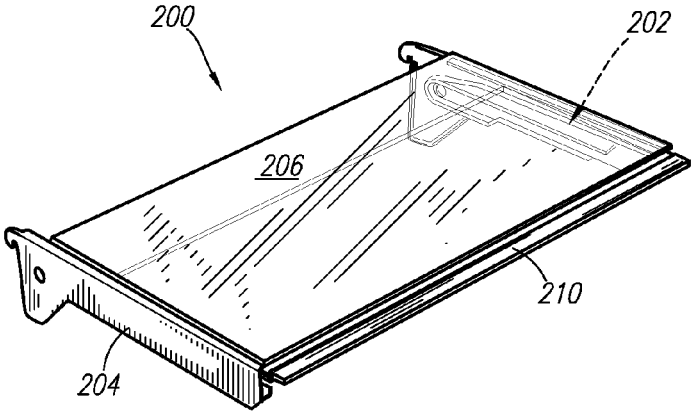
FIG. 2A illustrates an example embodiment of a slide under shelf described herein in a retracted state.
Figure 2B:
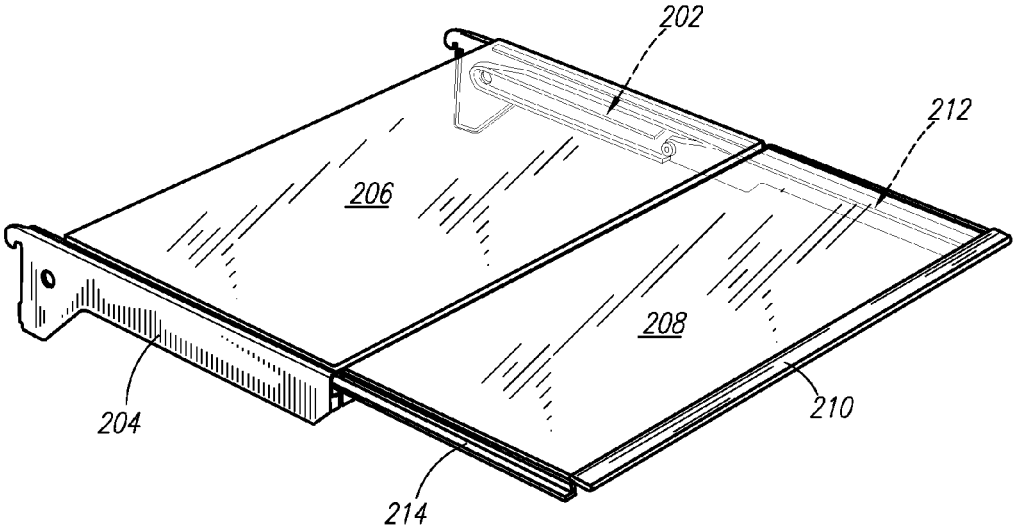
FIG. 2B illustrates an example embodiment of a slide under shelf described herein in an extended state.

In contrast, FIGS. 2A and 2B illustrate an example embodiment of an armless slide under shelf 200 that does not require permanently extended arms. As can be seen in FIG. 2A, in a retracted state, a first shelf area of the shelf 200 comprises two support arms 202, 204 on opposite sides of a first top surface 206. The support arms 202, 204 extend beyond the first top surface 206 only at the rear of the first shelf area. That is, the support arms 202, 204 are not permanently extended to support a second shelf area as is the case in FIG. 1. The second shelf area with a second top surface 208 is stored under the first shelf area and first top surface 206. The second shelf area may comprise a handle 210 to provide an easier grip for a user when extending the shelf 200. As shown in FIG. 2B, in an extended state (i.e., a rear edge of the second top surface 208 is near or beyond a front edge of the first top surface 206), the second shelf area can be completed extended without any change or extension of support arms 202, 204.

Figure 3:
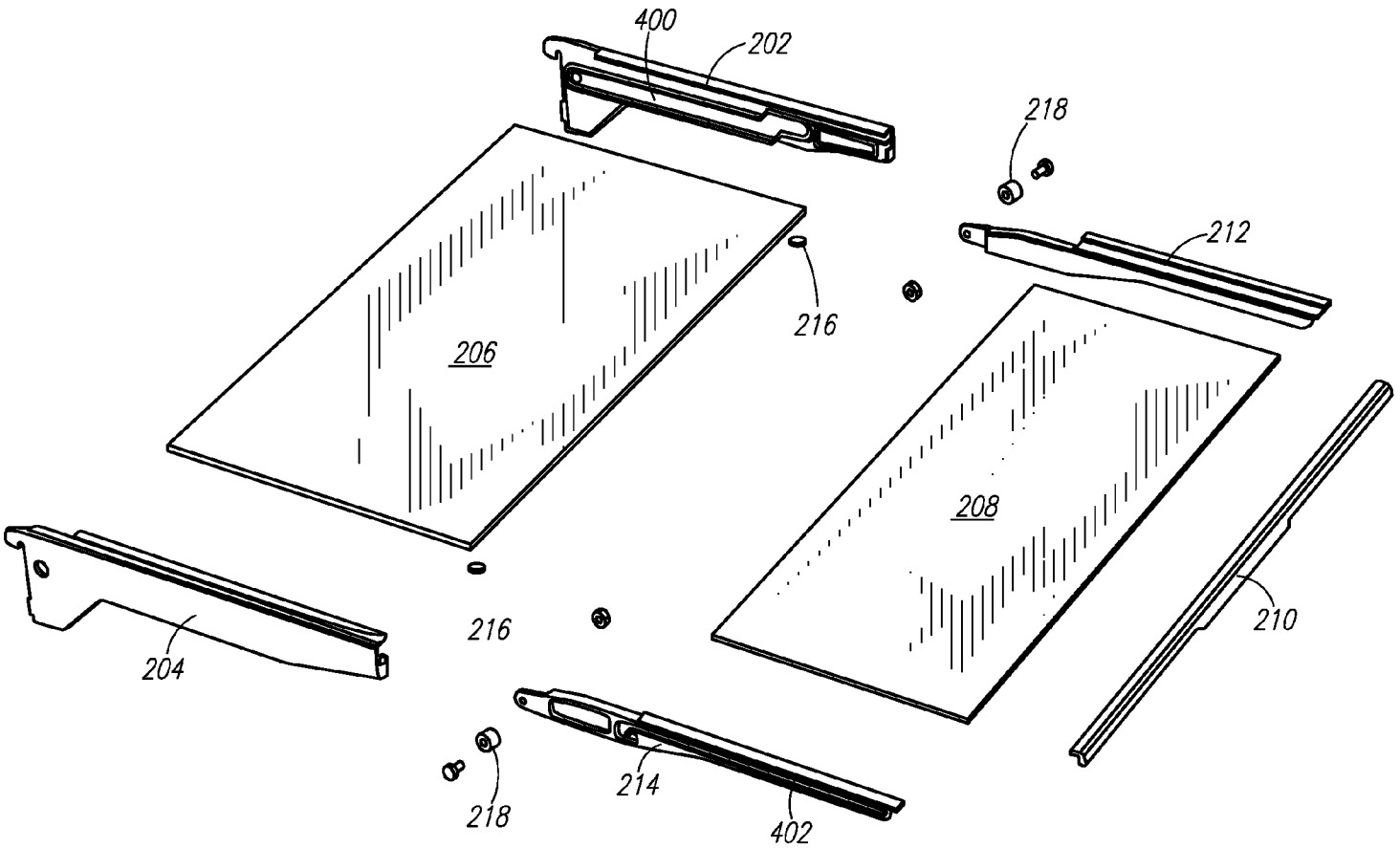
FIG. 3 illustrates an exploded view of a slide under shelf described herein.

To fully describe the structure of armless slide under shelf 200, FIG. 3 illustrates an exploded view of the shelf 200. Support arms 202, 204 attach to the first top surface 206 on opposite sides of the top surface 206. Interior faces of support arms 202, 204 comprise a track 400 for guiding the slide under movement of second shelf area. First sliding members in the form of posts 216 are attached near the front of the interior sides of the support arms 202, 204. Although not shown, a trim may be attached along the front edge of the first top surface 206.

Front slides 212, 214, which interconnect with the track 400 of the support arms 202, 204 are attached to opposite sides of the second top surface 208 of the second shelf area and extend beyond the rear edge of the second top surface 208. Similar to support arms 202, 204, the exterior sides of front slides 212, 214 comprise a track 402. Second sliding members in the form of wheels 218 are bolted near the rear edge, of the exterior face of the front slides 212, 214, beyond the track 402 and second top surface 208. A front edge of the second shelf area comprises a trim attached to the front of the second top surface 208. The trim 210 may be formed as or comprise a handle 210, or similar shape, to improve a user's grip and/or ability to pull out the second shelf area of the slide under shelf.

In an example embodiment, the support arms 202, 204 and front slides 212, 214 are made of aluminum; the trim and/or handle 210 may be formed from plastic; the posts 216 and wheels 218 may be made from a nylon or similar polymer; and the first and second shelf areas 206, 208 may be made of glass. The first and second top surfaces 206, 208 may be attached to the support arms 202, 204, front slides 212, 214, and trim using adhesives, friction fit connectors, and the like. However, it is to be understood that each element may be made from any such materials, including but not limited to, aluminum, nylon, polymers, rubbers, plastics, glass, and the like, and combinations thereof. Additionally, it is to be understood that various methods of attachment may be used without departing from the scope of the present disclosure. While the wheels shown in FIG. 3 use a bolt and nut, similar axel systems may be used to secure the wheel 218, or a roller, to the front slides 212, 214.

Figure 4A:
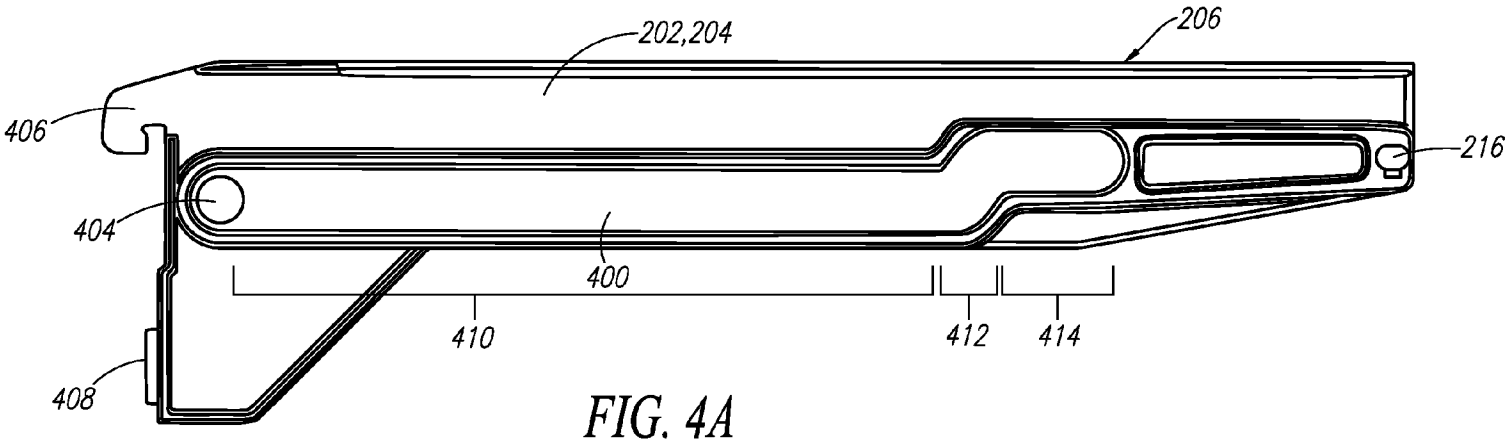
FIG. 4A illustrates a side view of an example embodiment of a first shelf area of a slide under shelf described herein.
Figure 4B:
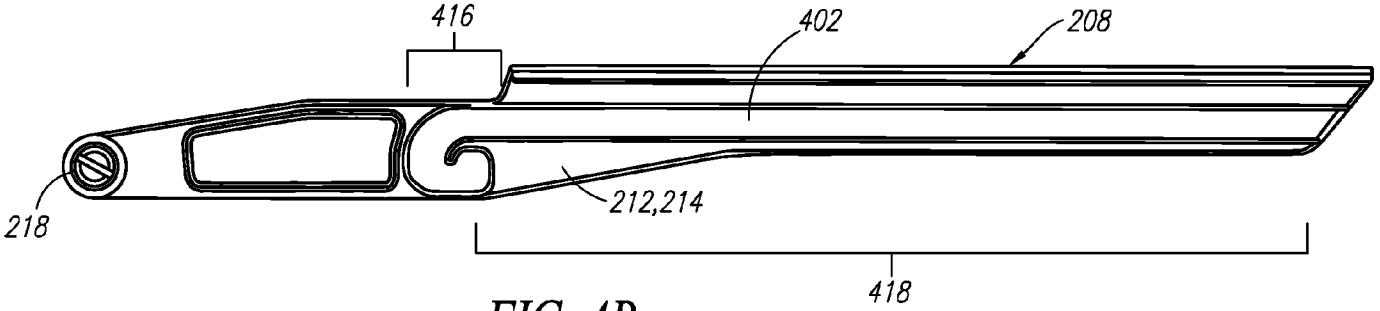
FIG. 4B illustrates a side view of an example embodiment of a second shelf area of a slide under shelf described herein.

Turning now to a description of the operation of the tracks 400, 402 of the support arms 202, 204 and front slides 212, 214, FIGS. 4A and 4B illustrate a view of the interior face of support arms 202, 204 and the exterior face of front slides 212, 214. The track 400 of the support arms 202, 204, extends generally longitudinally along the support arms 202, 204. The track 400 comprises three sections: a first horizontal section 410, a ramp section 412, and a second horizontal section 414, the horizontal sections being substantially parallel with each other and the second horizontal section being closer to the first top surface 206 of the first shelf area. A hole lock 404 is located at the rear of the first horizontal section of the track 400. Support arms 202, 204 further comprise a hook 406 and notch 408 extending from the rear end. The hook 406 and notch 408 allow the shelf 200 to attach to a modular rail along a wall of a refrigeration appliance. It should be noted that while FIG. 4A illustrates a hook 406 and notch 408, other attachments may be used, for example, bolts, adhesive, a plurality of hooks, and the like, without affecting the function or scope of the slide under shelf 200 described herein.

The track 402 of the front slides extends generally longitudinally underneath the second top surface 208. The track 402 comprises a semi-circular section 416 that wraps underneath a horizontal section 418 at the rear of the track 402. When assembled, the posts 216 of the support arms 202, 204 fit within the track 402 of the front slides 212, 214. Similarly, the wheels 218 of the front slides 212, 214 fit within the track 400 of the support arms 202, 204.

Figure 5:
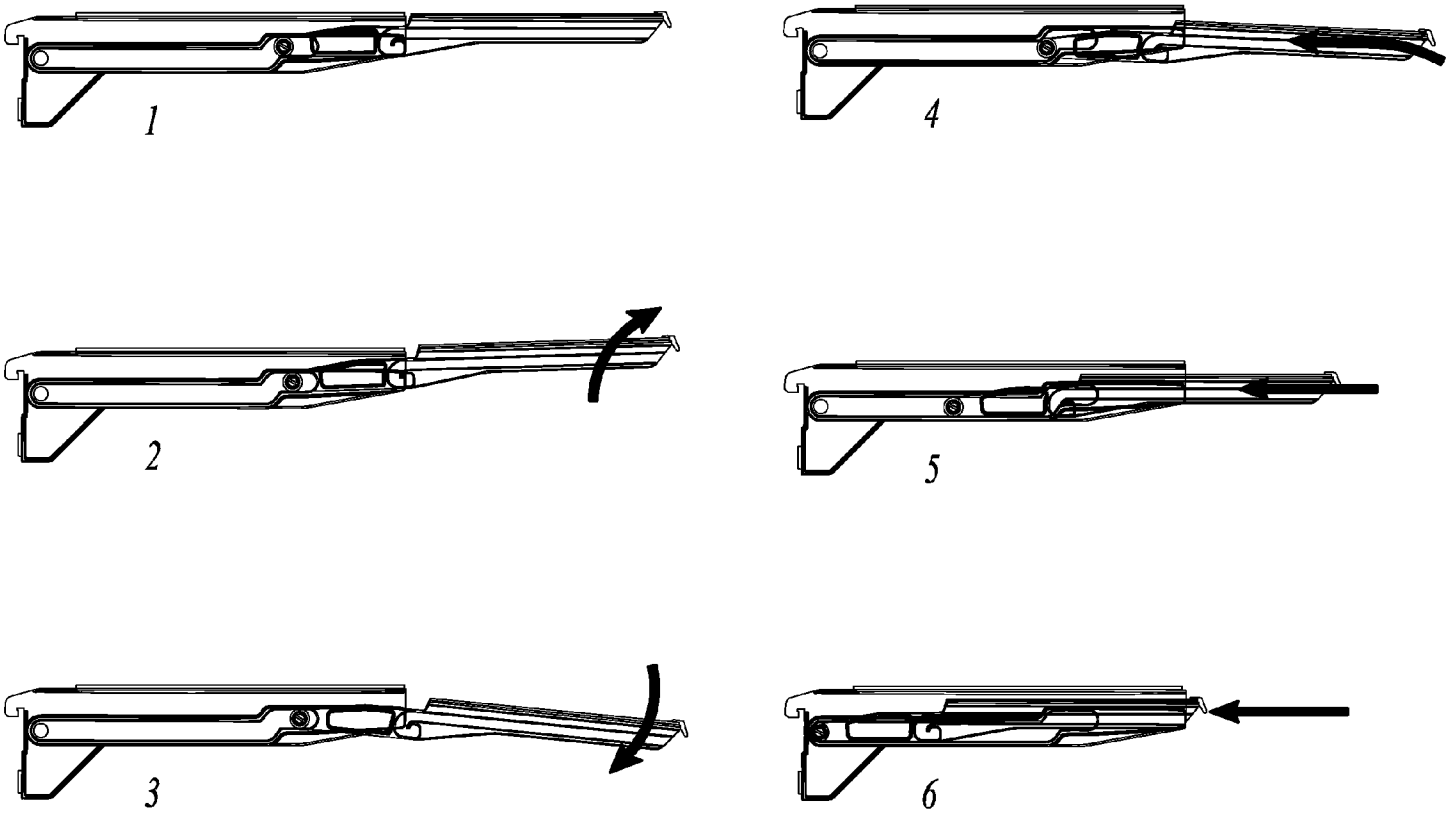
FIG. 5 illustrates the operation of an example embodiment of a slide under shelf described herein.
Figure 6:
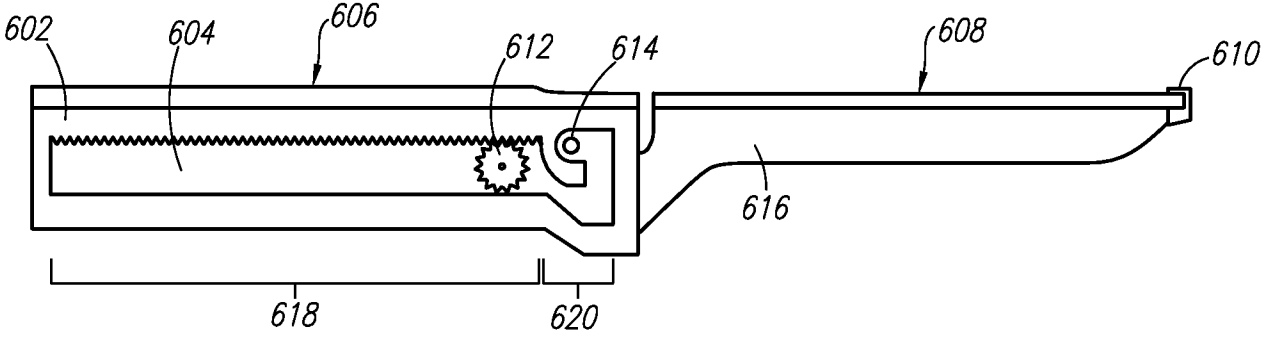
FIG. 6 illustrates another example embodiment of a slide under shelf described herein.

Using this configuration, the slide under shelf 200 may be operated as illustrated in FIG. 5. As shown in FIG. 5, to retract the shelf 200 when it is in an extended position, a user may first lift the second shelf area, using the handle 210, or the like, and pull the second shelf area outwardly away from the first shelf area. This movement causes the posts 216 to rotate around the semi-circular section of the track 402. The second shelf area 208 can then be dropped and pushed in while leveling the second shelf area. Meanwhile, the wheel 218 rides along track 400 along the second horizontal section 414, down the ramp section 412, and along the first horizontal section 410. When the shelf has been fully retracted, the wheel 218 can fit within hole lock 404 to lock the shelf in place. The steps of the above description may be reversed to arrange the shelf 200 in an extended position. The wheels 218 may be released from the hole lock 404 simply by pulling on the second shelf area FIG. 6 illustrates another example embodiment of an armless slide under shelf 600. As described above with respect to shelf 200, slide under shelf 600 comprises support arms 602 with track 604 and a first top surface 606. A second shelf area may comprise a handle 610 or the like and a second top surface 608. Front slide supports 616 extend beyond the rear of the second top surface 608 and comprise first and second sliding members—a toothed wheel 612 (e.g., a gear) and a post 614. The toothed wheel 612 and post 614 are located near the rear of the front slide supports 606, beyond the second top surface 608, the wheel 612 being closer to the rear of the front slide supports than the post 614. The track 604 comprises a horizontal toothed section 618 that extends substantially longitudinally and an arcuate section 620 at a front end of the track 604. As with slide under shelf 200, in order to retract the shelf 600 when extended, a user may lift up and pull out the second shelf area 608 using handle 610, then let the second shelf area 608 drop and push the second shelf area 608 inward. In doing so, the post 614 rotates about the arcuate section 620 and the wheel 612 rolls along the horizontal section 618 of the track 604.

It is to be understood that the foregoing detailed description is not meant to be limiting in any way. Rather, it describes various preferred embodiments of the present invention.

I claim:

1. A slide under shelf comprising:

a first shelf area having a first top surface and support arms attached at opposite edges, wherein the support arms each have a first track that extends longitudinally on an interior face of the support arm and the support arms each have a first sliding member beyond the track in a first longitudinal direction; and a second shelf area having a second top surface and front slides attached at opposite edges, wherein the front slides each have a second track that extends longitudinally on an exterior face of the front slide, and a second sliding member beyond the track and the second top surface in a second longitudinal direction, wherein each second sliding member fits within a corresponding one of the first tracks of the support arms, and the first sliding member fits within a corresponding one of the second tracks of the front slides.

2. The slide under shelf of claim 1, wherein the second shelf area further comprises a handle.

3. The slide under shelf of claim 1, wherein the second sliding member is a wheel.

4. The slide under shelf of claim 1, wherein the first top surface and second top surface are glass.

5. The slide under shelf of claim 1, wherein the support arms and front slides are plastic.

6. The slide under shelf of claim 1, wherein the first track of the support arms comprises a first horizontal section, a ramp section, and a second horizontal section, the second horizontal section being closer to the first top surface than, and substantially parallel with, the first horizontal section.

7. The slide under shelf of claim 1, wherein the second track of the front slides comprises a horizontal section and an arcuate section, the arcuate section located at the end of the horizontal section closest to the second sliding member.

8. The slide under shelf of claim 1, wherein the support arms do not extend beyond the first top surface in the first longitudinal direction.

9. A refrigeration appliance comprising:

a slide under shelf, the slide under shelf comprising:

a first shelf area having a first top surface and support arms attached at opposite edges, wherein the support arms each have a first track that extends longitudinally on an interior face of the support arm and the support arms each have a first sliding member beyond the track in a first longitudinal direction; and a second shelf area having a second top surface and front slides attached at opposite edges, wherein the front slides each have a second track that extends longitudinally on an exterior face of the front slide, and a second sliding member beyond the track and the second top surface in a second longitudinal direction, wherein each second sliding member fits within a corresponding one of the first tracks of the support arms, and the first sliding member fits within a corresponding one of the second tracks of the front slides.

10. The slide under shelf of claim 9, wherein the second shelf area further comprises a handle.

11. The slide under shelf of claim 9, wherein the second sliding member is a wheel.

12. The slide under shelf of claim 9, wherein the first top surface and second top surface are glass.

13. The slide under shelf of claim 9, wherein the support arms and front slides are plastic.

14. The slide under shelf of claim 9, wherein the first track of the support arms comprises a first horizontal section, a ramp section, and a second horizontal section, the second horizontal section being closer to the first top surface than, and substantially parallel with, the first horizontal section.

15. The slide under shelf of claim 9, wherein the second track of the front slides comprises a horizontal section and an arcuate section, the arcuate section located at the end of the horizontal section closest to the second sliding member.

16. The slide under shelf of claim 9, wherein the support arms do not extend beyond the first top surface in the first longitudinal direction.

* * * * *